United States Patent [19]

Palmer et al.

[11] Patent Number: 5,027,093

[45] Date of Patent: Jun. 25, 1991

[54] MOLDED CASE CIRCUIT BREAKER ACTUATOR-ACCESSORY UNIT HAVING COMPONENT TOLERANCE COMPENSATION

[75] Inventors: Thomas M. Palmer, Wallingford; Roger N. Castonguay, Terryville, both of Conn.

[73] Assignee: General Electric Company, New York, N.Y.

[21] Appl. No.: 604,535

[22] Filed: Oct. 29, 1990

[51] Int. Cl.[5] ..... H01H 9/00

[52] U.S. Cl. ..... 335/176; 335/42

[58] Field of Search ..... 335/38-45, 335/21-22, 35, 167-176

[56] References Cited

U.S. PATENT DOCUMENTS

| | | | |
|---|---|---|---|
| 4,008,449 | 2/1977 | Morris et al. | 335/176 |
| 4,074,218 | 2/1978 | Salvati et al. | 335/176 |
| 4,297,663 | 10/1981 | Seymour et al. . | |
| 4,589,052 | 5/1986 | Dougherty . | |
| 4,622,444 | 11/1986 | Kandatsu et al. . | |
| 4,679,019 | 7/1987 | Todaro et al. . | |
| 4,691,182 | 9/1987 | Mrenna et al. | 335/176 |
| 4,700,161 | 10/1987 | Todaro et al. . | |
| 4,728,914 | 3/1988 | Morris et al. . | |
| 4,743,878 | 5/1988 | Ohishi et al. | 335/172 |
| 4,806,893 | 2/1989 | Castonguay et al. . | |
| 4,808,953 | 2/1989 | Ito et al. | 335/42 |
| 4,825,179 | 4/1989 | Nagamoto et al. . | |
| 4,894,631 | 1/1990 | Castonguay et al. . | |
| 4,965,543 | 10/1990 | Batteux | 335/174 |
| 4,973,928 | 11/1990 | Grunert | 335/38 |
| 4,983,989 | 1/1991 | Shea et al. | 335/42 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A compact circuit breaker containing an electronic trip unit employs an actuator-accessory unit to articulate the circuit breaker operating mechanism and separate the circuit breaker contacts to interrupt current within a protected circuit. A tolerance compensating spring is attached to the actuator-accessory unit trip armature to precisely set the separation gap between the tip of the armature and the actuator-accessory trip actuator arm.

11 Claims, 4 Drawing Sheets

FIG. 5A
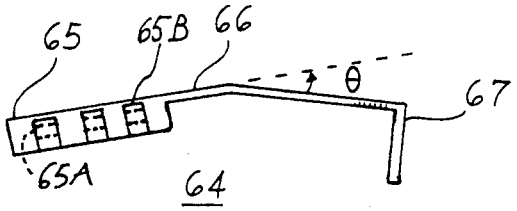
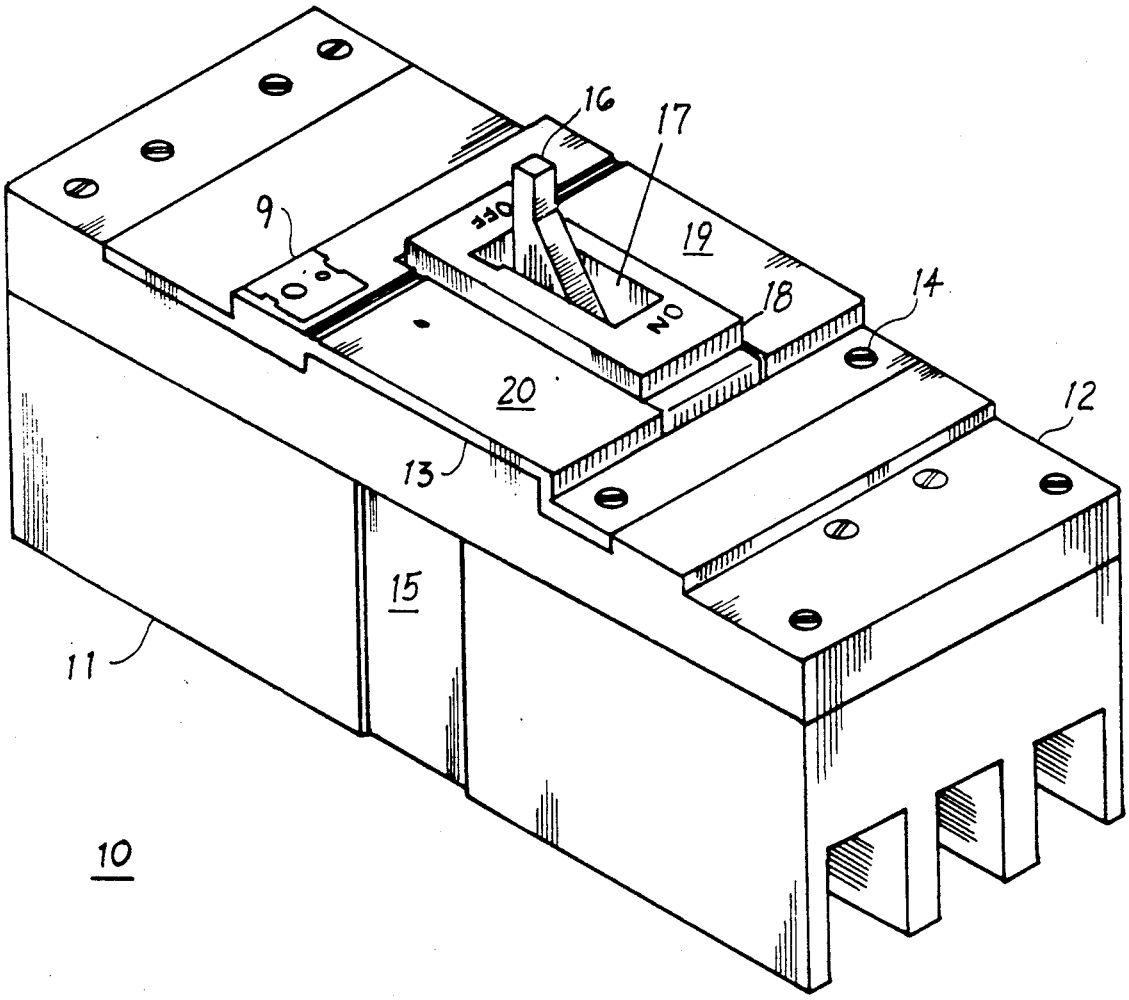
FIG. 1

MOLDED CASE CIRCUIT BREAKER ACTUATOR-ACCESSORY UNIT HAVING COMPONENT TOLERANCE COMPENSATION

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which Patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. 4,700,161 entitled "Combined Trip Unit and Accessory Module for Electronic Trip Circuit Breakers". The aforementioned U.S. Patents which represent the advanced state of the art of circuit protection devices are incorporated herein for reference purposes.

U.S. Pat. No. 4,806,893 describes a molded case circuit breaker actuator-accessory unit wherein the integrated overcurrent trip actuator and multiple accessory unit containing the control electronics and mechanical interface components are contained on a single structure mounted within a single recess. In some circuit breaker designs the actuator unit and the accessory unit are mounted within separate enclosures. The accessory, for example, could comprise a shunt trip or undervoltage device as described within the aforementioned U.S. Patent.

A recent example of a combined circuit breaker actuator-accessory unit is found within U.S. Pat. No. 4,894,631 entitled "Molded Case Circuit Breaker Actuator-Accessory Unit". The actuator-accessory unit employs several springs for propelling the trip armature and resetting the actuator-accessory levers. The components are carefully selected to result in a predetermined fixed separation gap between the tip of the actuator-accessory armature and the actuator-accessory trip actuator arm to compensate for the accumulative tolerances of the actuator-accessory unit components. A recent example of a means for positioning an armature relative to an electromagnet is found within U.S. Pat. No. 4,825,179.

The instant invention improves over the earlier trip actuator-accessory unit by the provision of a tolerance take-up spring on the actuator-accessory armature tip to precisely set the separation gap between the actuator-accessory armature tip and the actuator-accessory trip actuator arm.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The actuator-accessory unit component tolerances are automatically compensated by means of a gap-adjusting spring attached to one end of the actuator-accessory trip armature.

BRIEF DESCRIPTION OF THE DRAWINGS

FIG. 1 is a top perspective view of a molded case circuit breaker containing the actuator-accessory unit according to the invention;

FIG. 5A is an enlarged side view of the tolerance compensating spring within the actuator-accessory unit of FIG. 5.

DESCRIPTION OF THE PREFERRED EMBODIMENT

Figure 2:
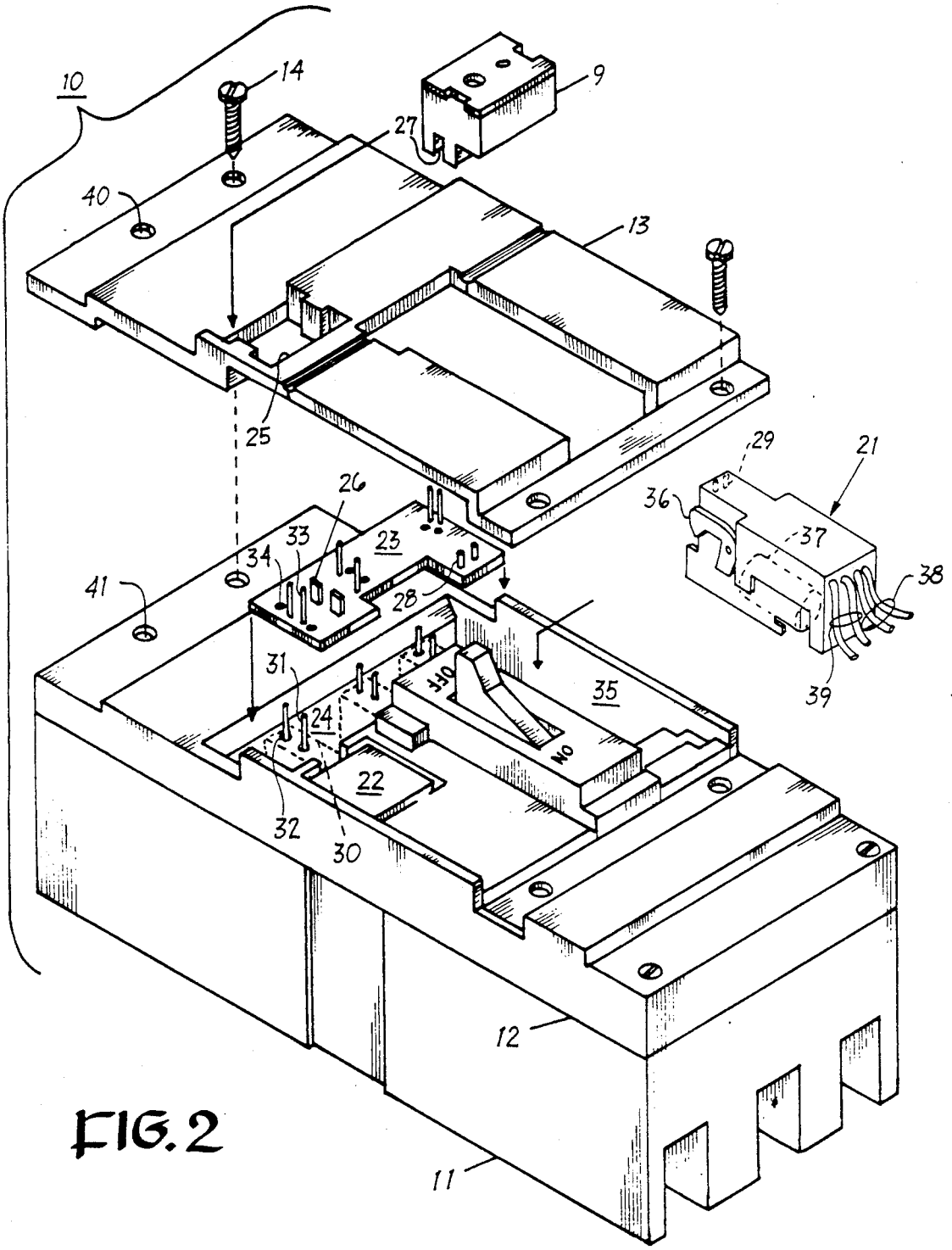
FIG. 2 is an exploded top perspective view of the circuit breaker of FIG. 1 prior to assembly of the actuator-accessory unit according to the invention.

An integrated circuit breaker 10 consisting of a molded plastic case 11 with a molded plastic cover 12 is shown in FIG. 1 with the accessory cover 13 attached to the circuit breaker cover by means of screws 14. The case includes a wiring slot 15 formed therein for allowing external connection with a remote switch or alarm. The circuit breaker operating handle 16 extends up from an access slot 17 formed in the cover escutcheon 18. A rating plug 9 such as described in U.S. Pat. No. 4,728,914 entitled "Rating Plug Enclosure for Molded Case Circuit Breakers", is shown assembled within the accessory cover. A pair of accessory doors 19, 20 are formed in the accessory cover for providing access to the combined electromagnetic actuator and multiple accessory unit 21, hereafter "actuator-accessory unit" and the auxiliary switch 22 as shown in FIG. 2.

The trip unit for the integrated circuit breaker 10 is contained within a printed wire board 23 shown in FIG. 2 which is positioned in the trip unit recess 24 formed in the bottom of the circuit breaker cover 12. The rating plug 9 when inserted within the rating plug recess 25 interconnects with the printed wire board 23 by means of pin connectors 26 upstanding from the printed wire board and sockets 27 formed on the bottom of the rating plug. The pin connectors 28 upstanding from the opposite end of the printed wire board connect with the sockets 29 provided on the bottom of the actuator-accessory unit 21. Electrical connection between the current transformers 30 located within the circuit breaker case 11 under the trip unit recess 24 electrically connect with the printed wire board 23 by means of pin connectors 31 extending through apertures 32 formed through the bottom of the printed wire board recess and pin connectors 33 upstanding from the printed wire board and by means of apertures 34 through the printed wire board. When the auxiliary switch and trip unit printed wire board have been assembled within their appropriate recesses, the actuator-accessory unit 21 is then installed within the actuator-accessory unit recess 35. As described within the aforementioned U.S. Pat. No. 4,894,631, the actuator-accessory latch 36 interacts with the circuit breaker operating mechanism 43 (FIG. 3) and is controlled by means of an actuator-accessory coil 37. External electrical access to the actuator-accessory coil and the associated circuitry is made by means of conductors 38, 39. When the actuator-accessory unit 21 and the auxiliary switch 22 are positioned within the circuit breaker cover 12, the accessory cover 13 is attached to the circuit breaker cover by means of the screws 14, thru-holes 40 formed within the accessory cover and threaded openings 41 formed in the circuit breaker cover.

Figure 3:
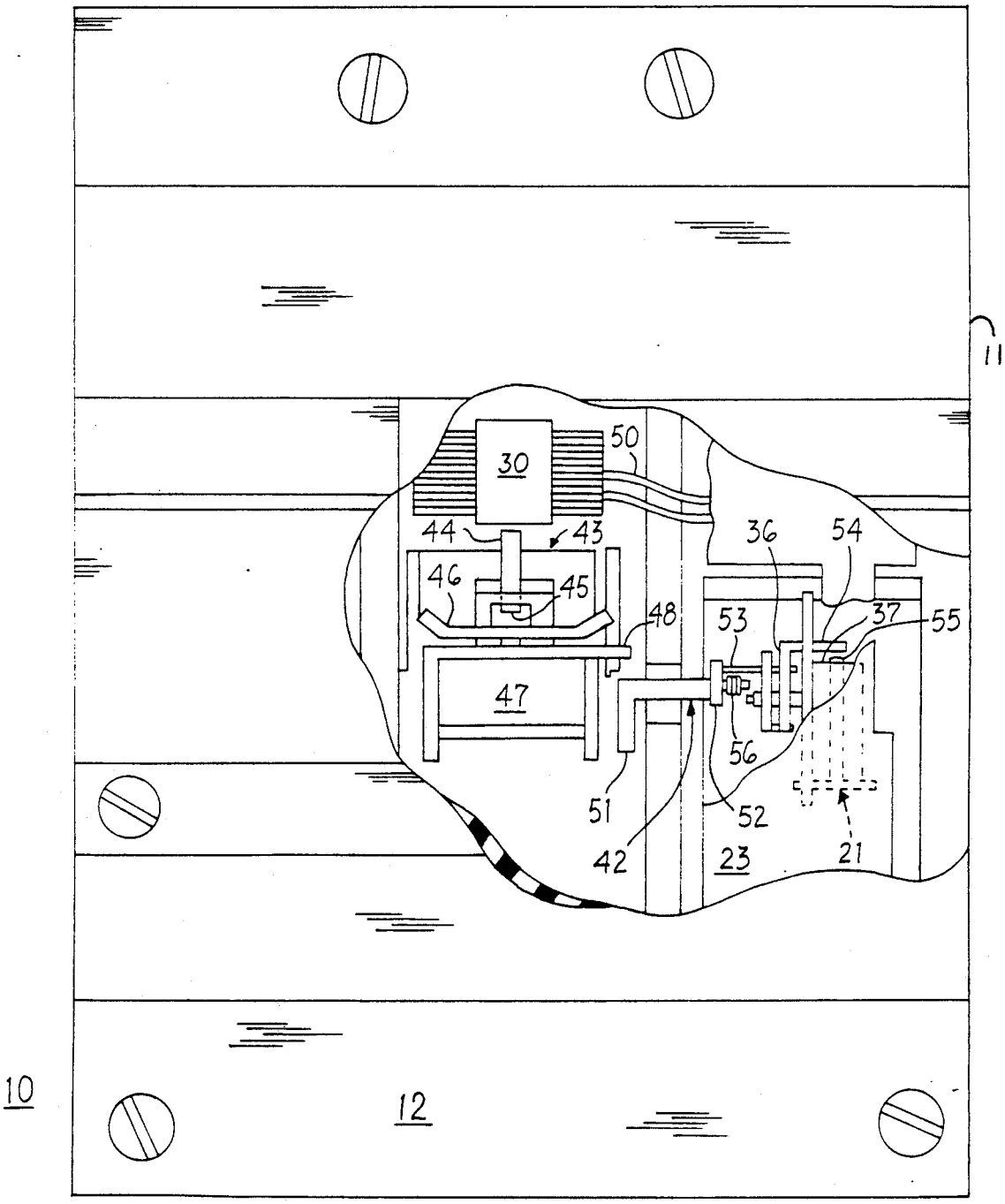
FIG. 3 is a top plan view of the circuit breaker of FIG. 1 with the cover removed to depict the interaction of the actuator-accessory of the invention with the circuit breaker operating mechanism.
Figure 4:
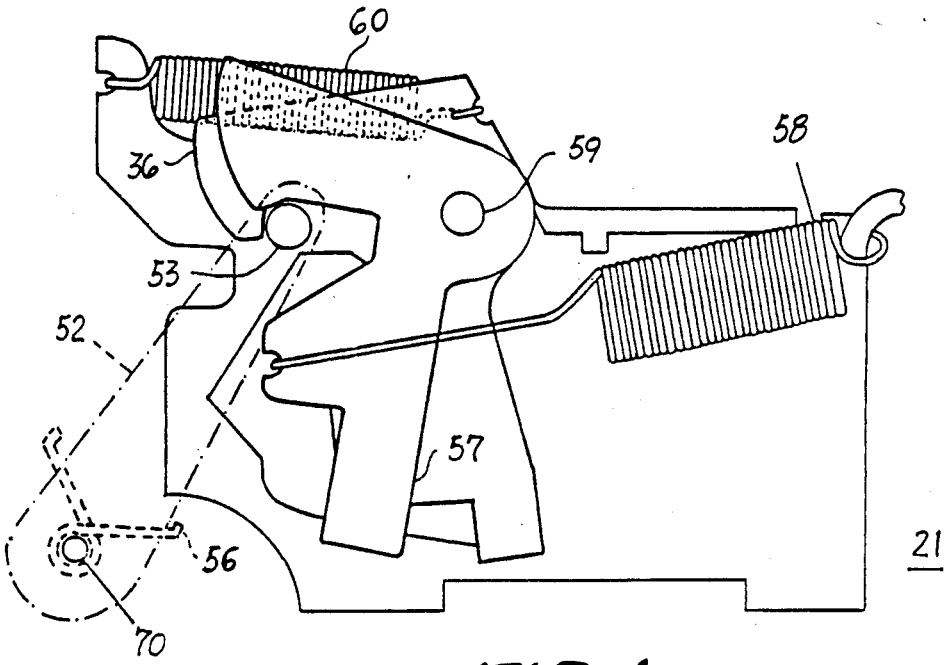
FIG. 4 is an enlarged side view of the mechanical actuator and magnetic latch arrangement of the actuator-accessory of FIG. 3.

The actuator-accessory unit 21 is depicted in FIG. 3 within the circuit breaker 10 with part of the trip unit printed wire board 23 and cover 12 removed to show the interaction between the actuator-accessory unit and the mechanical actuator 42 which sits in the integrated circuit breaker cover 12. The circuit breaker operating mechanism shown generally at 43 includes a cradle operator 44 having a hook 45 formed at one end thereof which is retained by means of a primary latch 46. The secondary latch assembly 47 prevents the primary latch from releasing the operating cradle until the secondary latch is displaced by contact with a tab 48 extending from the secondary latch. Electric current flow is sensed by the current transformers 30. The current transformers connect with the trip unit printed wire board 23 by means of conductors 50. The operating lever 51 sits within the case 11 and connects with the latch support arm 52 on the mechanical actuator 42. The latch pin 53 is retained by the actuator-accessory latch 36 which is in turn controlled by the position of the trip actuator arm 54. The trip actuator arm interfaces with the armature extension 55 on the actuator-accessory unit 21 in the following manner. When the circuit current exceeds a predetermined value, a current pulse is applied to the actuator-accessory coil 37 to oppose the holding force provided by the permanent magnet 61 (FIG. 5) thereby allowing the armature extension 55 to be propelled under the urgence of the actuator-accessory spring 62 (FIG. 5) to thereby rotate the trip actuator latch 36 and to release the latch pin 53 from the actuator-accessory latch 36. The rotation of the actuator-accessory latch allows the latch support arm 52 to rotate under the urgence of a powerful trip spring 56. The rotation of the latch support arm in turn drives the operating lever 51 into contact with the tab 48 thereby articulating the circuit breaker operating mechanism 43 to separate the circuit breaker contacts (not shown). The interaction between the operational components of the accessory-actuator latch 36, latch pin 53, latch support arm 52 and trip spring 56 is best seen by referring now to FIGS. 4 and 5. The "latched" condition of the actuator-accessory unit 21 described within aforementioned U.S. Pat. No. 4,894,631 is shown in FIG. 4 wherein the latch pin 53 is engaged by the actuator-accessory latch 36. The reset lever 57 is biased by the reset spring 58 about the common pivot pin 59 for both the reset lever and the actuator-accessory latch 36 which is biased by means of the take-up spring 60. As shown in phantom, the latch support arm 52 is biased by means of the trip spring 56 about a separate pivot pin 70.

Figure 5:
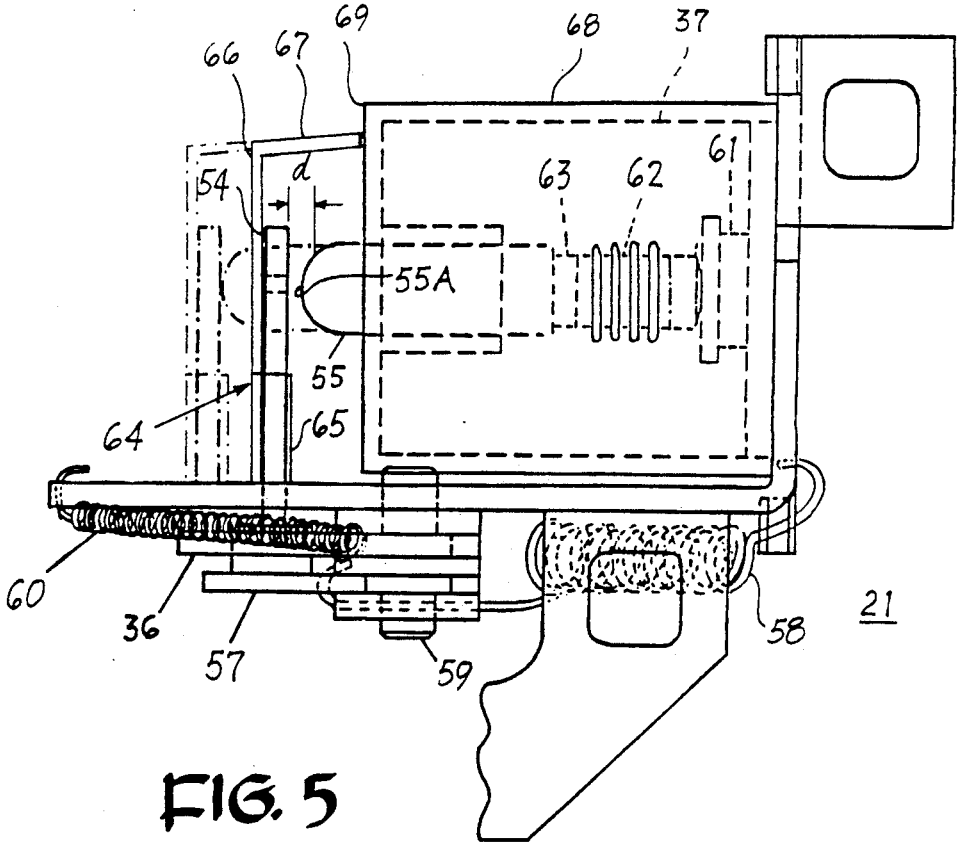
FIG. 5 is an enlarged top plan view of the actuator-accessory unit of the invention containing an automatic tolerance compensating spring.

The actuator-accessory unit 21 is shown in FIG. 5 with the armature extension 55 positioned ahead of the armature 63 and held against the spring bias provided by the actuator-accessory spring 62 by means of the permanent magnet 61. The actuator-accessory coil 37 contained within the actuator-accessory coil housing 68 responds to trip signals in the manner described earlier to electromagnetically counter the magnetic force provided by the permanent magnet such that the armature extension strikes the trip actuator arm 54 and rotates the actuator-accessory latch 36 out of contact with the latch pin 53 (FIG. 4) to articulate the circuit breaker operating mechanism as described earlier with reference to FIG. 3. When the trip actuator arm 54 is displaced by the armature extension 55 to the position shown in phantom, the actuator-accessory latch 36 rotates against the bias provided by the take-up spring 60. When the armature extension 55 is returned to the reset position indicated in solid lines, the reset lever 57 operates in the manner described within aforementioned U.S. Pat. No. 4,894,631 under the bias of the reset spring 58 about the common pivot pin 59 to complete the resetting operation of the actuator-accessory unit 21.

After the armature 63 is reset against the permanent magnet 61, when performing the tripping function described earlier, a separation gap, indicated at d, must be maintained between the tip 55A of the armature extension 55 and the trip actuator arm 54 to ensure that the actuator-accessory spring 62 becomes fully extended when later released from the permanent magnet. Should the tip 55A of the armature extension rest against the trip actuator arm, for example, the inertia provided by the force of the actuator arm could cause a slight delay to the movement of the armature extension and prevent the actuator-accessory spring from being fully extended. The various tolerances accumulated between the components within the actuator-accessory unit must be carefully controlled to ensure that a gap is maintained between the armature extension and the trip actuator arm after resetting of the armature. According to the invention, a predetermined separation gap d is maintained between the tip 55A of the armature extension and the trip actuator arm by means of the tolerance take-up spring 64 which is positioned on the trip actuator arm 54 by means of the base clip portion 65. The offset extended arm portion 66 includes a bent tab 67 that accurately sets the gap by resiliently contacting the front part 69 of the actuator-accessory coil housing 68. When the trip actuator arm 54 becomes displaced, as indicated in phantom, the tolerance take-up spring 64 is carried by the trip actuator arm as also shown in phantom and returns to the position indicated in solid lines to accurately set the separation gap d.

The tolerance take-up spring 64 is depicted in FIG. 5A to show the angle 0 to which the extended arm portion 66 is offset from the plan of the base clip portion 65 to ensure that the bent tab 67 is string-biased against the front part of the actuator-accessory coil housing as described earlier with reference to FIG. 5. To facilitate a press-fit attachment between the base clip portion 65, a slot 65A is defined within the base clip portion by selectively bending a part of the base clip portion as indicated at 65B. The tolerance take-up spring 64 can be added to the trip actuator arm either during the manufacturing process or later installed in the field, if so desired.

Having thus described our invention, what we claim as new and desire to secure by Letters Patent is:

We claim:

1. A trip actuator unit or accessory unit for molded case circuit breakers comprising:

a housing;

an electromagnetic coil within said housing arranged about a spring-biased armature said armature being restrained from movement by magnetic means;

a trip actuator latch pivotally attached to said housing by means of a pivot pin and being biased for rotation in a first direction by means of a take-up spring;

trip means on said trip actuator latch interfacing with said armature whereby said armature strikes said trip means causing said trip actuator latch to rotate in a second direction when said magnetic means is cancelled; and gap adjusting means on said trip means interacting with said housing to thereby provide a predetermined separation gap between said armature and said trip actuator latch.

2. The trip actuator unit or accessory unit of claim 1 wherein said trip means comprises a trip actuator arm extending at an angle from said trip actuator latch.

3. The trip actuator unit or accessory unit of claim 1 including a reset lever pivotally attached to said housing by means of said pivot pin and being biased for rotation in said second direction by means of a reset spring.

4. The trip actuator unit or accessory unit of claim 2 wherein said adjusting gap means comprises a flexible arm having shaped means at one end attached to said trip means.

5. The trip actuator unit or accessory unit of claim 4 further including a bent tab on an opposite end of said flexible arm said bent tab contacting a part of said housing to thereby provide said predetermined separation gap between said armature and said trip actuator latch.

6. The trip actuator unit or accessory unit of claim 4 wherein said shaped means comprises a clip formed with said flexible arm whereby a part of said trip actuator arm is press-fit within said clip.

7. A molded case circuit breaker having a combined trip actuator and accessory unit comprising:

a molded case circuit breaker case and cover;

a circuit breaker operating mechanism arranged for separating a pair of contacts to interrupt circuit current through said contacts;

a trip actuator-accessory unit within a recess in said circuit breaker cover proximate said operating mechanism and including a trip actuator latch pivotally arranged for articulating said operating mechanism to separate said contacts automatically upon overcurrent conditions through said contacts, said trip actuator latch comprising a radial cam surface for receiving and guiding a trip latch pin;

an operating lever within said case proximate said operating mechanism and interfacing with said actuator-accessory unit through a latch support arm, said latch support arm carrying said trip latch pin, whereby said trip latch pin is retained by said trip actuator latch in the absence of said overcurrent conditions through said contacts;

an electromagnetic coil within a housing and a spring-biased armature extending exterior to said housing, and interfacing with said trip actuator latch said armature being restrained from moving said trip actuator latch away from said latch pin; and gap adjusting means on said trip actuator latch interacting with said housing to thereby provide a predetermined separation gap between said armature and said trip actuator latch.

8. The circuit breaker of claim 7 including a reset lever pivotally attached with said trip actuator lever and being biased for rotation by means of a reset spring.

9. The circuit breaker of claim 6 wherein said gap adjusting means comprises a flexible arm having shaped means at one end attached to said trip actuator lever.

10. The circuit breaker of claim 3 further including a bent tab on an opposite end of said flexible arm said bent tab contacting a part of said housing to thereby provide said predetermined separation gap between said armature and said trip actuator latch.

11. The circuit breaker of claim 9 wherein said shaped means comprises a clip formed with said flexible arm whereby a part of said trip actuator lever is press-fit within said clip.

* * * * *